US005292177A

United States Patent [19]

Balderi et al.

[11] Patent Number: 5,292,177

[45] Date of Patent: Mar. 8, 1994

[54] MODULAR SEATING SYSTEM

[75] Inventors: Nicola Balderi, Green Bay; David R. Funk, De Pere, both of Wis.

[73] Assignee: Krueger International, Inc., Green Bay, Wis.

[21] Appl. No.: 820,318

[22] Filed: Nov. 25, 1991

[51] Int. Cl.[5] ..... A47C 15/00

[52] U.S. Cl. ..... 297/232; 297/248; 297/DIG. 2; 297/135

[58] Field of Search ..... 297/232, 248, 440, 445, 297/249, DIG. 2, 135

[56] References Cited

U.S. PATENT DOCUMENTS

| | | | |
|---|---|---|---|
| 2,647,791 | 8/1953 | Barenyi | 297/440 X |
| 3,230,005 | 1/1966 | Staples | 297/440 X |
| 3,261,640 | 7/1966 | Straits | 297/440 X |
| 3,822,078 | 7/1974 | Spadolini | 297/140 |
| 3,877,747 | 4/1975 | Brennan et al. | 297/232 X |
| 4,114,949 | 9/1978 | Benoit | 297/445 |
| 4,166,297 | 9/1979 | Saleeby | 297/183 X |
| 4,662,679 | 5/1987 | Franck et al. | 297/249 X |
| 4,828,324 | 5/1989 | Putnam | 297/440 |

FOREIGN PATENT DOCUMENTS

| | | | |
|---|---|---|---|
| 0188002 | 7/1986 | European Pat. Off. | 297/232 |
| 2241820 | 3/1973 | Fed. Rep. of Germany | 297/232 |

*Primary Examiner*—Peter R. Brown
*Assistant Examiner*—Milton Nelson, Jr.
*Attorney, Agent, or Firm*—Ryan, Kees & Hohenfeldt

[57] ABSTRACT

A modular seating system in which at least two supporting elements serve a dual function including that of providing a seat support and an additional function. Each such supporting element includes a hollow shape having vertical supporting walls and is formed from a cured organic polymer reinforced by an inert fibrous filler such as glass fibers. The elements support a seating component that includes a beam provided with a first plate affixed at each end in a plane perpendicular to the axis of the beam. The beam is affixed at each end and suspended by one of the supporting elements. Mechanical fasteners extend through the plates and through a vertical wall of said hollow shapes. A second reinforcing plate is provided on the inside of said vertical wall, and the mechanical fasteners also extend through the second reinforcing plates, causing the first and second plates to apply compressive force on the supporting wall. One or more seating units are attached to and supported by the beam. The supporting components can act both as a seat support and a table, planter or kiosk.

9 Claims, 2 Drawing Sheets

10
11
12
14
15
16
17
18
20
21
30
32
34
36

15
16
20
22
24
26
28

6
6
15
16
18
20
22

15
16
18
20
22

MODULAR SEATING SYSTEM

FIELD OF THE INVENTION

This invention relates to seating systems. More particularly the invention relates to a modular seating system which can be assembled in differing configurations for indoor and outdoor use and of a type used in reception areas or waiting areas such as in office buildings, medical facilities, malls, schools, universities or transportation terminals.

RELATED ART

Various types of seating arrangements, such as metal or molded fiberglass reinforced resin seats or fabric covered individual seats have heretofore been utilized for public seating. Such seating may be in the form of individual seats as linear units, generally supported on legs and optionally secured to the floor. A need, however, has continued to exist for economical, functional and attractive seating arrangements, particularly of a type that allows assembly of differing physical arrangements utilizing the same components.

SUMMARY OF THE INVENTION

A principal object of the present invention is to provide a modular seating arrangement in which the components can readily be rearranged to fit the particular use area. A related object is to provide such a system which is both economical and aesthetically appealing. A further aspect relates to the use of inexpensive components which are nonetheless durable and functional.

A further related aspect of the invention relates to the use of components which serve more than one functional purpose. In accordance with this aspect, a component of the modular system can act both as a seat support and also serve a second function such as that of a table, planter, stack to form a kiosk, or the like.

Briefly summarized, the invention relates to a modular component for a seating system in which at least two supporting elements serve a dual function including providing a seat support together with an additional function. Each such supporting element includes a hollow shape having vertical supporting walls and is formed from a cured organic polymer reinforced by an inert fibrous filler such as glass fibers. The elements support a seating component that includes a beam provided with a first plate affixed at each end in a plane perpendicular to the axis of the beam. The beam is affixed at each end and suspended by one of the supporting elements. Mechanical fasteners extend through each of the first plates and through a vertical wall of said hollow shapes. A second reinforcing plate is provided on the inside of each vertical wall, at the point of attachment, and the mechanical fasteners also extend through the second reinforcing plates. Tightening of the fasteners causes the first and second plates to apply compressive force on the supporting wall. One or more seating units are attached to and supported by the beam. The seating units may optionally either be backless seats or are provided with back rests.

The supporting elements may be provided in a variety of shapes, such as cross-sections in a horizontal plane that are rectangular, triangular, halfround or a sector of a circle. Tall objects can be formed by attaching a supporting beam to one of such shaped articles and then stacking nesting elements of similar cross-section above it. A further characteristic of the preferred embodiment of the supporting elements is the inclusion of a reinforcing sheet of plywood affixed to the interior of the supporting shape. The reinforcing sheet is preferably bonded to the interior wall of the shape using a resin as the bonding agent.

BRIEF DESCRIPTION OF THE DRAWINGS

Further objects, advantages and other aspects of the invention will be apparent from the following detailed description and accompanying drawings wherein.

DESCRIPTION OF THE PREFERRED EMBODIMENT

Figure 1:
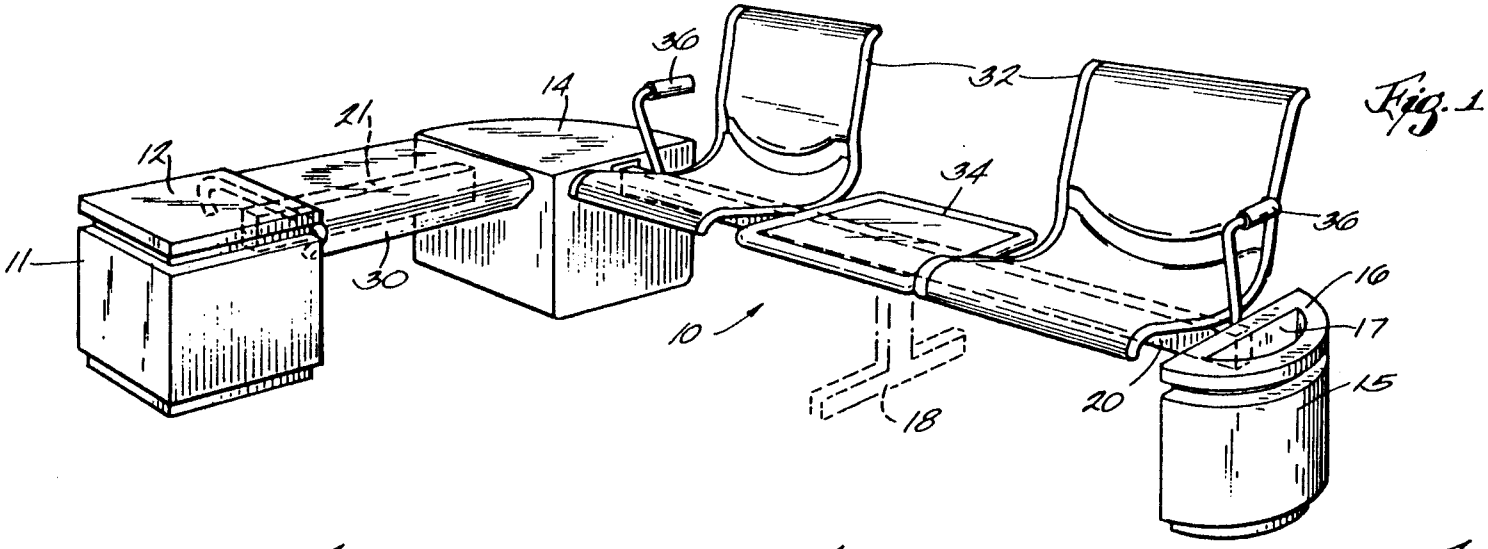
FIG. 1 is a perspective view of a typical assembled modular seating arrangement of this invention.

Referring to FIG. 1, an exemplary modular seating arrangement 10 is shown in one possible arrangement. In the illustrated arrangement there is a supporting element 11 having a top 12, a different shape such as a sector of a circle 14, or a semi-circle 15. An end element 15 is also illustrated as having a top 16 shown to be a flat surface. It is contemplated, however, that other surfaces such as ashtrays, kiosks, planters, or the like can be provided. Decorative inserts 17 formed from wood veneer, natural or synthetic stone, laminates or glass or plastics can be incorporated into the tops of the supporting elements 11, 14 or 15.

Conventional supporting legs 18, as shown by dotted lines, can be used to centrally support long spans. Beams 20 and 21 are supported between elements 11, 14 and 15 as illustrated. The parts can be assembled at angles other than rectangular by using one or more intermediate supporting elements 14 which may be either triangular or in the shape of a sector of a circle less than 90°, for example, 30°, 45°or 60°.

Affixed to the end of beams 20 and 21 are plates 22 which are preferably welded at right angles to the end of the beams. However, if desired, in the case, for example, of wooden beams used in place of metal beams, it may be desirable to secure plates 22 by means of screws or the like.

The walls of supporting elements 11, 14 or 15 are preferably formed from fiberglass reinforced cured organic polymers such as polyester resins. Other resins such as epoxies, polyurethanes, polyureas, or the like can be substituted as desired. Instead of glass fibers, metallic fibers, ceramic fibers or polymeric fibers may be used for reinforcement purposes if desired.

Figure 6:
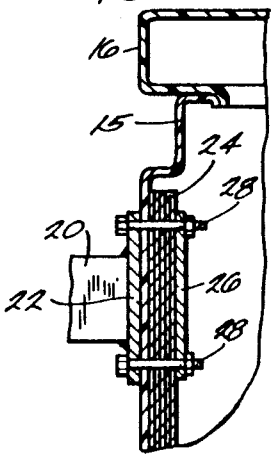
FIG. 6 is a cross-sectional view taken along line 6—6 of FIG. 5.
Figure 5:
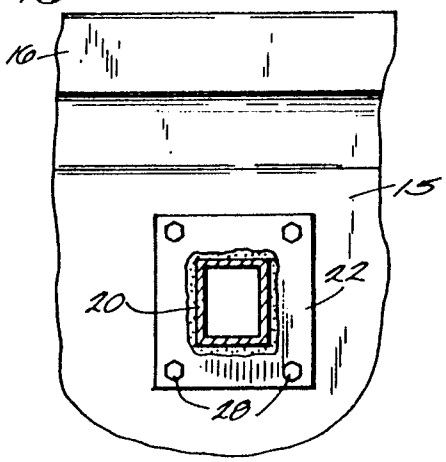
FIG. 5 is a cross-sectional view taken along line 5—5 of FIG. 3.
Figure 4:
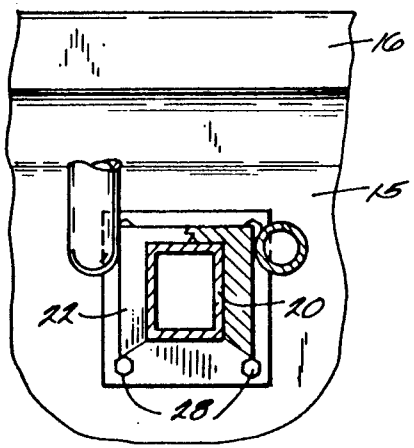
FIG. 4 is a cross-sectional view taken along line 4—4 of FIG. 3 with parts broken away for clarity.
Figure 3:
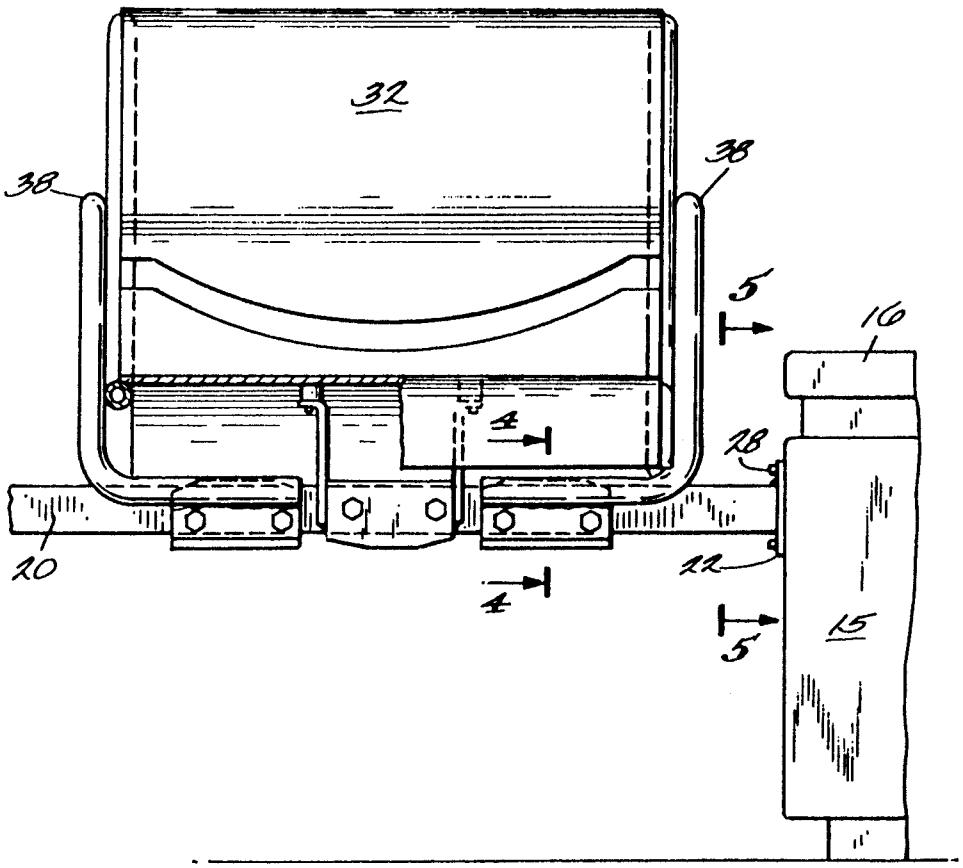
FIG. 3 is a front view of a supporting element, supporting beam and seat component of this invention with parts broken away for clarity.
Figure 2:
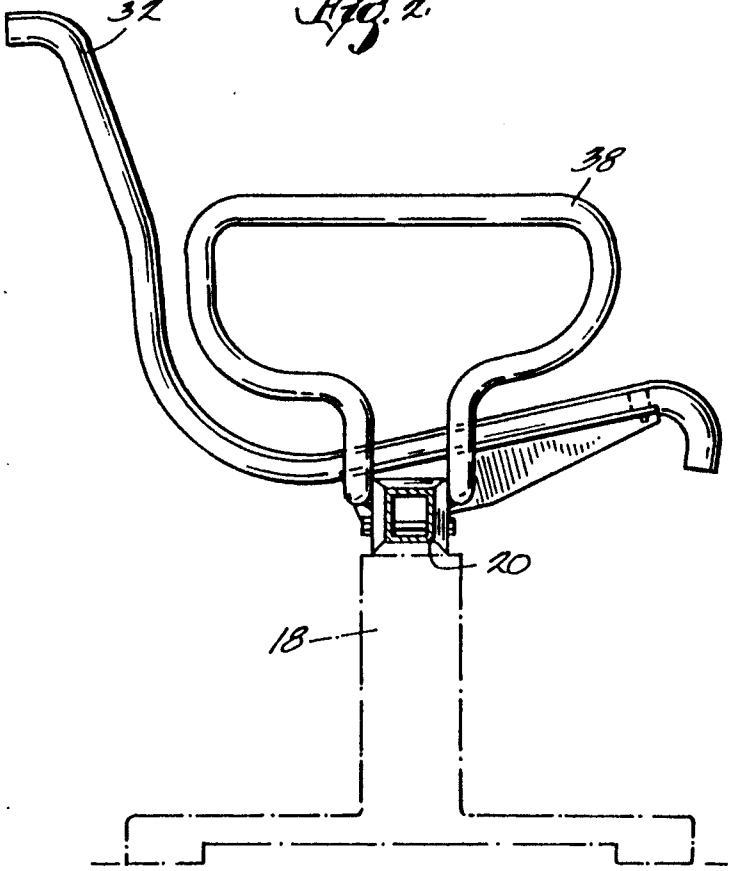
FIG. 2 is an end view of a supporting beam and seat of this invention showing an alternate armrest style.

As best seen in FIG. 6, it is preferred to secure a reinforcing sheet such as a layer of plywood 24 on the inner vertical wall of the supporting element. The reinforcing layer 24 can be bonded to the inner wall by means of a cured polymeric bonding agent. It is preferred in the case of polyester resins to use the same resin as a bonding agent as is used for formation of the vertical wall. Combinations of various resins may be used instead, however. A second plate 26 is placed over the inner wall or the inner surface of reinforcing member 24. Aligned holes are provided through plates 22, the vertical wall of the supporting element, the reinforcing member 24 and the inner plate 26. Mechanical fasteners such as bolt 28 are placed in the aligned holes and tightened in order to suspend an end of beam 20. The use of opposed reinforcing plates 22 and 26 causes compressive forces to be exerted on the wall and reinforcing member upon tightening of fasteners 28. Secured to beams 20 and 21 may be a backless seat 30 or a seat 32 provided with a backrest. A table such as indicated at 34 can also be secured to the beams. Armrests can also be provided, for example, of a cantilevered configuration 36 or a closed loop configuration 38.

While the invention has been described in connection with the illustrated specific embodiments, it is to be understood that various modifications and variations will be apparent to those skilled in the art. Accordingly, the invention is intended to embrace all such alternatives, modifications and variations within the scope of the claims appended hereto.

We claim:

1. A modular component for a seating system comprising at least two supporting elements, each comprising a hollow shape having vertical supporting walls and being formed from a cured polymeric material reinforced by an inert fibrous filler, a seating component comprising a beam provided with a first reinforcing plate affixed at each end of said beam, said plate at each end of said beam being positioned in a plane perpendicular to the longitudinal axis of said beam, said plate having a broad surface having an area substantially greater than the cross sectional area of said beam, said beam being at each of its ends affixed to and suspended by one of said supporting elements, mechanical fasteners extending through said first reinforcing plates and through a vertical wall of said hollow shapes, a second reinforcing plate being provided on the inside of said vertical wall, said fasteners extending through said second reinforcing plates and causing said first and second plates to apply compressive force on said supporting wall, at least one seating unit attached to and supported by said beam.

2. A seating component according to claim 1 wherein said fibrous filler comprises glass fibers.

3. A component according to claim 1 wherein said polymeric material comprises a polyester resin.

4. A component according to claim 1 wherein said supporting shape has a cross section in a horizontal plane that is selected from the group consisting of square, rectangular, triangular, half-round, and sector of a circle.

5. A component according to claim 1 further comprising a reinforcing sheet of plywood affixed to the interior of said supporting shape and abutting said second reinforcing plate.

6. A seating component according to claim 1 wherein said seating units comprise a seat secured to said beam and a back rest attached to said seat.

7. A seating component according to claim 4 wherein said seat is provided with armrests.

8. A component according to claim 4 wherein said seat comprises perforated metal.

9. A component according to claim 8 wherein said perforated metal seat is partially covered by fabric.

* * * * *